United States Patent [19]

Neal et al.

[11] 4,422,887

[45] Dec. 27, 1983

[54] HEAT TREATMENT

[75] Inventors: Donald F. Neal, Tamworth; Paul A. Blenkinsop, Sutton Coldfield, both of England

[73] Assignee: IMI Kynoch Limited, Birmingham, England

[21] Appl. No.: 293,960

[22] Filed: Aug. 18, 1981

[30] Foreign Application Priority Data

Sep. 10, 1980 [GB] United Kingdom ..... 8029075

[51] Int. Cl.[3] ..... C22F 1/18

[52] U.S. Cl. ..... 148/133

[58] Field of Search ..... 148/11.5 F, 12.7 B; 1/133

[56] References Cited

U.S. PATENT DOCUMENTS

| | | | |
|---|---|---|---|
| 3,649,374 | 3/1972 | Chalk | 148/11.5 F |
| 3,833,363 | 9/1974 | Bomberger, Jr. et al. | 148/133 |
| 4,087,292 | 5/1978 | Neal et al. | 148/133 |
| 4,094,708 | 6/1978 | Hubbard et al. | 148/133 |

FOREIGN PATENT DOCUMENTS

| | | |
|---|---|---|
| 776440 | 6/1957 | United Kingdom . |
| 853539 | 11/1960 | United Kingdom . |
| 911148 | 11/1962 | United Kingdom . |
| 944130 | 12/1963 | United Kingdom . |
| 1449134 | 9/1976 | United Kingdom . |

OTHER PUBLICATIONS

Nishimura et al., "The Age Hardening Characteristics and Mechanical Properties in Titanium Alloy T:-2-Co-1Zr", *Titanium Science and Technology* Plenum Press, N.Y., 1973, pp. 1853-1867.

*Primary Examiner*—Peter K. Skiff

*Attorney, Agent, or Firm*—Cushman, Darby & Cushman

[57] ABSTRACT

A heat treatment process to improve the strength of weldable near alpha titanium alloys comprising solution treating the alloy in the beta field and stress relief treating the alloy at two different temperatures, one of which is at 535° C.±100° C., particularly suitable for the titanium alloy containing 5.5% aluminium, 3.5% tin, 3% zirconium, 1% niobium, 0.25% molybdenum, 0.3% silicon.

3 Claims, 5 Drawing Figures

HEAT TREATMENT

BACKGROUND OF THE INVENTION

This invention relates to the heat treatment of metals and has particular reference to the heat treatment of titanium near alpha alloys.

The search for improved mechanical properties in titanium alloys has normally taken the route of modifying the composition of the alloy to improve the balance of properties available. Titanium alloys have been in existence commercially for a little over 30 years and it is becoming increasingly difficult to design new titanium alloys with improved properties.

Initial improvements were made quite rapidly, but the rate of development has slowed down as the law of diminishing returns takes effect. Undoubtedly improvements will occur in the future. However, even small improvements in properties are valuable in that they enable aero engines to be designed so as to be lighter and hence more fuel efficient. The need for fuel efficiency in aero engines is so great that aero engine designers are looking to use titanium alloys in ever hotter regions of the engine to enable weight savings to be obtained. There is, therefore, a great deal of pressure on the metallurgist to improve the balance of metallurgical properties present in the alloy.

As mentioned above most of the emphasis on improving properties has gone towards modifying the composition of the alloy. Little practical evaluation has been given to modifications to the heat treatment to be used on the alloys. This invention is, however, concerned with the improvement in titanium alloys by modifying the heat treatment given to them during their processing.

As in the case of many metals titanium exists mainly in two distinct phases, a so-called alpha phase and a so-called beta phase. The beta phase is more stable at elevated temperatures and the proportions of alpha and beta in various titanium alloys are defined by the composition and heat treatment of the alloys. Certain alloying elements used in titanium stabilise the alpha phase and these are frequently referred to as alpha stabilisers. Other alloying elements stabilise the beta phase and these are frequently referred to as beta stabilisers. Certain titanium alloys consist almost completely of alpha titanium when in equilibrium at room temperature with a trace of beta—less than 5% beta. These alloys are sometimes referred to as near alpha alloys and certain of the alloys are properly regarded as weldable. A near alpha titanium alloy may also be regarded as one containing not more than about 2% by weight of beta stabilisers such as molybdenum copper silicon etc. A more complete definition of a near alpha titanium alloy is an alpha stabilised alloy, that is an alloy containing alpha stabilising elements, with an amount of beta stabiliser which gives a small volume fraction (less than about 5%) of retained beta and which can be beta processed and/or beta heat treated and give acceptable ductility and fracture resistance.

The term "weldable" as used herein is not intended merely to refer to the ability of the metal to be welded directly to itself but is intended to refer to the metal being useable in an aircraft engine in the welded condition. The only two weldable near alpha beta heat treated alloys in existence at the present time are the alloys known as IMI 685, namely the alloy 6% aluminium, 5% zirconium, 0.5% molybdenum, 0.25% silicon, balance titanium and 5331S, namely the alloy 5.5% aluminium, 3.5% tin, 3% zirconium, 1% niobium, 0.25% molybdenum, 0.3% silicon, balance titanium. All percentages as used herein are weight percentages. The near alpha alloys are conventionally used in the solution treated and stress relieved condition. The solution treatment of the alloy 5331S conventionally comprises a treatment at 1050° C. for a time depending on section size—one hour per 2.5 cm. The alloy is then oil quenched and is given a stress relief treatment for two hours at 625° C. although the exact stress relief time may vary with section. The solution treatment modifies the metallurgical structure of the alloy and the stress relieving treatment stress relieves the alloy from the stresses built up in the alloy during the quenching phase.

It will be appreciated that different types of titanium alloys have different types of heat treatment. Thus a conventional heat treatment for a near alpha alloy has been solution treatment in the beta field followed by a stress relieving treatment at a temperature typically in the region 525°–625° C. for a time of about 24 hours. By comparison, however, other types of titanium alloys are given a very different type of heat treatment. Thus an age hardenable titanium alloy, such as titanium plus 2½% copper, would be given an alpha solution treatment at about 800° C. followed by a nucleation treatment at 400° C. for 8 hours to nucleate the typical "Duralumin" type precipitate and then a further heat treatment at 475° C. for 8 hours to grow the precipitate. The alloy titanium plus 2½% copper is one which contains only beta stabilisers and is normally treated in the alpha plus beta or alpha plus compound regions of the phase diagram. In effect alloys of this precipitation hardening type rely on forming, at room temperature, a supersaturated solution of copper in the alpha phase. Subsequently the age hardening heat treatments result in the diffusion of copper to precipitation sites and then further precipitation on these sites during subsequent heat treatment.

There are believed to be no commercially used fully beta stable titanium alloys. Experimental alloys such as titanium plus 20% molybdenum plus 10% vanadium are fully beta stabilised. The only heat treatment given to such alloys is to beta solution heat treat. No further heat treatment is given.

A typical metastable beta titanium alloy, such as titanium plus 15% molybdenum would be given a beta solution treatment at a temperature above 25° C. above the beta transus, i.e. 815° C. for the Ti+15% Mo alloy and it would then be water quenched to room temperature. The alloy would then be composed of 100% beta phase. It would then be given a single or duplex ageing to precipitate out from the beta phase either an omega phase or an alpha phase.

Alpha plus beta titanium, such as the alloy titanium plus 6% aluminium plus 4% vanadium is typically heat treated in one of two ways. In one way, the alloy is annealed at a temperature low in the alpha plus beta phase field—i.e. 700° C. to give equiaxed alpha plus retained beta. In the other heat treatment the alloy is solution treated in the alpha plus beta field, air cooled to room temperature and then stress relieved at a single temperature in the range 500° C. to 700° C. to give an equiaxed alpha plus transformed beta structure.

Plain alpha titanium such as commercial purity titanium is simply stress relieved with a single heat treatment in the range 600° C. to 700° C. to given an equiaxed primary alpha structure.

However, it is not possible to equate the heat treatment used for one type of alloy, such as an age hardenable alloy of the titanium plus 2½ copper type, with that required for another type of alloy, such as a metastable beta or near alpha alloy.

Although practical heat treatments have been developed for near alpha alloys and have been shown to work well it is not certain what is happening in the near alpha alloy when it is heat treated. During the solution treatment it is clear that the alloy is converted into the beta phase and during cooling converts mainly to the alpha phase. However the heat treatment given to stress relieve the alloy after cooling gives rise to numerous types of reactions within the alloy itself.

Thus during the stress relieving process it is quite probable that some form of ordering is taking place within the alpha matrix and furthermore some amount of precipitation of very fine particles of material is taking place within the matrix. Once precipitated the morphology of the precipitate is altered as the heat treatment persists. Furthermore subcells are formed within the alloy. In addition to changes in relation to the precipitate there are also changes in the composition of the matrix.

The relative speeds of the various reactions alter as the temperature of heat treatment changes and furthermore vary with the time at a given temperature. This makes the prediction of the outcome of a variation in heat treatment very difficult when it is considered on a detailed and practical scale.

A subcell of the type referred to above is basically a subgrain in which there is a small difference in the angle of the atomic planes between one cell and another of the order of 5°, whereas for a true grain boundary the angular differences between the atomic planes would normally be 30° or more. A subcell may be regarded as a sign of partial recovery within the alloy caused by small movements of dislocations in the alloy. As the amount of precipitate and the morphology of the precipitate changes, the ability of the precipitate to lock up dislocations also changes, and this again gives rise to variations in the properties of the material.

An important part of the stress relieving treatment given to near alpha alloys is to stress relieve the internal stresses built up in the alloy during the quenching from the solution treatment temperature. These stresses are conventionally relieved by the movement of dislocations within the material and by the reformation of grain boundaries, and consequently the effect of the type of precipitate and its morpholoy on stress relief is a further complication.

Although extending the time of the stress relief treatment or increasing the temperature of the heat treatment reduces the amount of internal stress, it has been found that in near alpha alloys this reduces the creep strength of the alloy very considerably. Thus from Table I it can be seen increasing the temperature of the stress relief treatment from 500° C. to 600° C. whilst keeping the duration of the treatment constant at 24 hours led to a doubling of the creep extension a marginal fall in the strength of the alloy and a significant reduction in ductility. The alloy being tested was the near alpha alloy IMI 685. All the material was solution treated at 1050° C. and oil quenched.

TABLE I

| Stress Relief Treatment | Creep T.P.S., 520° C. 310 N · mm$^{-2}$ 100 hrs, % | 0.2% PS Nmm$^{-2}$ | UTS Nmm$^{-2}$ | EL5D % | R in A % |
|---|---|---|---|---|---|
| 24 hrs/500° C. | — | 888 | 1016 | 12 | 23 |
| " | 0.063 | *922 | 1013 | 11.5 | 19* |
| 24 hrs/575° C. | — | 900 | 1013 | 7 | 16 |
| " | 0.119 | *936 | 1018 | 5 | 7* |
| 24 hrs/600° C. | — | 883 | 999 | 8 | 13 |
| " | 0.124 | *939 | 1008 | 3 | 8* |

*All post creep tensile test samples had their surfaces retained.

For each heat treatment pair, the upper line refers to material which has not been creep tested the lower line for material which has been creep tested.

The same effect of a fall in the creep strength was observed when the time of the stress relief treatment was increased at constant temperature.

Table II, below shows that increasing the stress relief time at a constant temperature gives an increase in strength but a marked reduction in creep strength. The alloy tested was 5331S which had been solution treated at 1050° C. for 2 hours and then oil quenched.

TABLE II

| Stress Relief Heat Treatment | Creep T.P.S., 540° C./300 Nmm$^{-2}$ 100 hr % | 300 hr % | 0.1% PS Nmm$^{-2}$ | 0.2% PS Nmm$^{-2}$ | UTS Nmm$^{-2}$ | EL5D % | R in A % |
|---|---|---|---|---|---|---|---|
| 2 hrs/625° C. | — | — | 845 | 865 | 999 | 14 | 17.5 |
| " | 0.084 | 0.256 | *913 | 932 | 1027 | 7.5 | 10* |
| 4 hrs/625° C. | — | — | 843 | 867 | 995 | 12 | 14 |
| " | 0.135 | 0.305 | *917 | 937 | 1030 | 8.5 | 8.5* |
| 8 hrs/625° C. | — | — | 861 | 881 | 1001 | 11 | 16 |
| " | 0.164 | 0.351 | *926 | 945 | 1038 | 6 | 7* |

*All post creep tensile test samples had their surfaces retained.

It will be appreciated that an alloy which has a good creep resistance is one which will extend as little as possible under creep loading conditions, i.e. the value of creep T.P.S. (total plastic strain) should be as low as possible.

It has now been discovered that the properties of near alpha alloys, and in particular 5331S, can be improved by modifying the heat treatment given heretofor to alloys of this type. In particular it has been found that the strength and creep resistance of the alloy can be improved by modification to the known heat treatment.

SUMMARY OF THE INVENTION

By the present invention there is provided a method of heat treating a near alpha titanium alloy which includes the steps of solution treating the alloy at a temperature in excess of 900° C. and then heat treating the alloy at a temperature in the region of 400° C. to 750° C. or 450° C. to 750° C. for a time in excess of 30 minutes wherein the improvement comprises carrying out two or more heat treatments at different temperatures with the first heat treatment taking place at a temperature lower than the or a subsequent heat treatment.

The alloy may be solution treated at a temperature in the beta field, preferably at a temperature in the range 990° C. to 1,100° C. dependent on the beta transus temperature of the alloy. The temperature may be 1 030° to 1 070° C. for 5331S.

One of the heat treatments, preferably the first, may take place at a temperature of 535° C.±100° C. or ±75° C. or ±50° C. or ±35° C. for a time between one and 168 hours. Preferably the said temperature of heat treatment may be 535° C.±30° C. or ±25° C. or ±20° C. or ±15° C. or ±10° C. or ±5° C. or 535° C. exactly. The duration of heat treatment may be 2, 4, 6, 8, 10, 12, 14, 16, 18, 20, 22, 24, 30, 36, 48, 50, 72, 100 or 168 hours.

The second heat treatment temperature may be 650° C.±50° C. or 600° C.±30° C. preferably 625° C. The duration of the second heat treatment may be in the range 1 to 168 hours.

The alloy may be cooled to ambient temperature between the solution treatment and the heat treatments. The alloy may be air cooled or may be quenched. The quenching may be by oil quenching. Alternatively the alloy may be cooled from the solution treatment temperature to the temperature of the first heat treatment. The latter cooling may be by quenching into a bath of molten material at or near the temperature of the first heat treatment, or may be effected by moving the alloy from a furnace at the solution temperature to a furnace at the temperature of the first heat treatment, or by cooling the alloy in the furnace from the solution temperature to the temperature of the first heat treatment, or by a combination of the methods.

Unexpectedly it has been found that using the multiple heat treatments of the present invention has enabled an increase in the time/temperature of the stress relief treatment to be effected—with its accompanying lowering of internal stress but with not only no reduction in creep strength but an actual improvement in creep strength. In view of previous knowledge and experience of the effect of increasing the time and or temperature of the stress relief treatment these results are most unexpected and it could not have been predicted that such an improvement in creep properties could have been obtained in this manner.

BRIEF DESCRIPTION OF THE DRAWINGS

By way of example embodiments of the present invention will now be described by way of example only with reference to the accompanying drawings of which.

DESCRIPTION OF THE PREFERRED EMBODIMENTS

Figure 1:
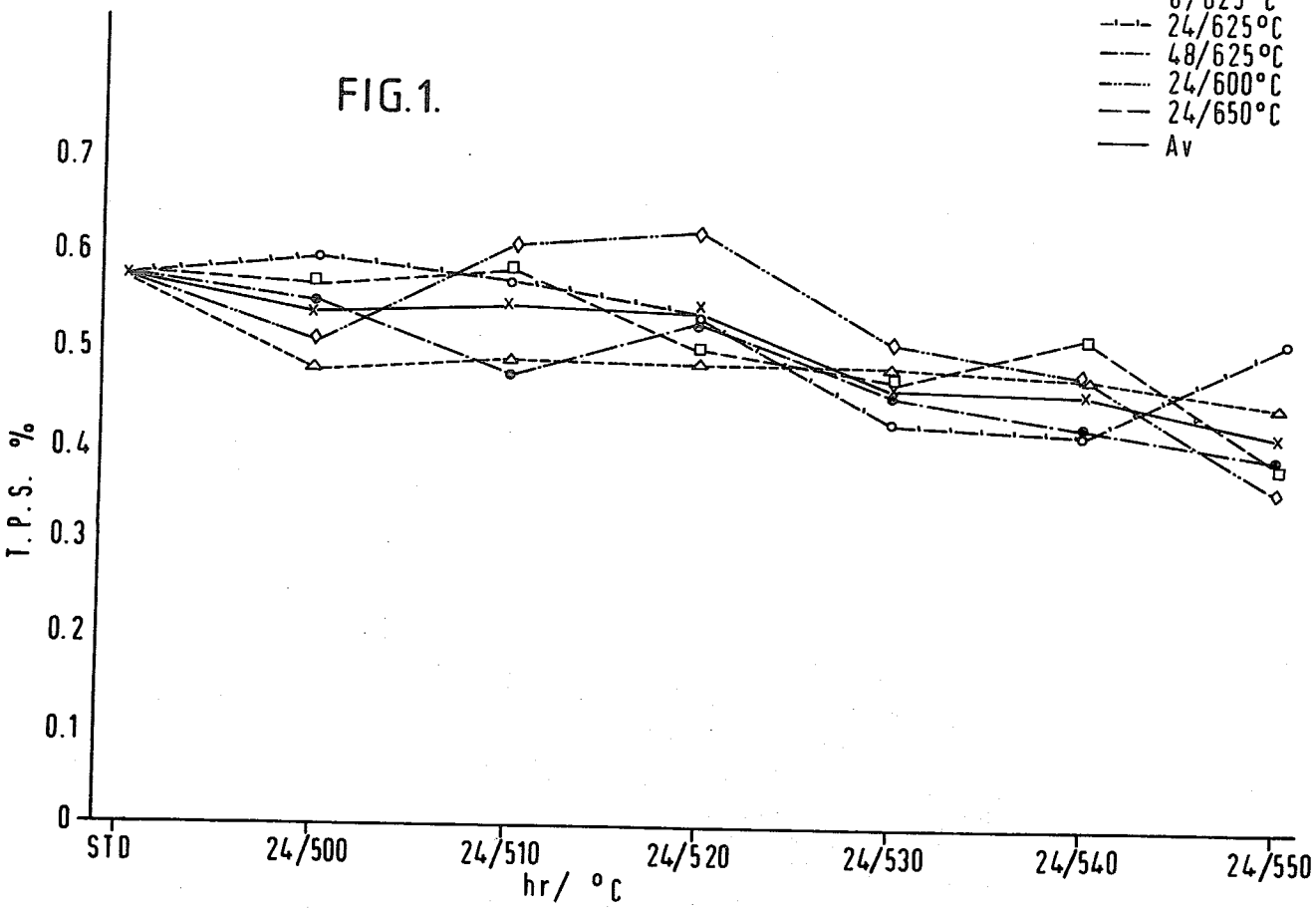
FIG. 1 is a graph of total plastic strain TPS against primary heat treatment hrs/°C.

Samples of titanium alloy bar of a composition 5.5% aluminium, 3.5% tin, 3% zirconium, 1% niobium, 0.25% molybdenum, 0.3% silicon, balance titanium (ie 5331S) were cut to shape. The samples were of 50 mm diameter and were of a sufficient length to permit conventional tensile test samples to be cut from them. A first set of four specimens were prepared and were solution treated for 2 hours at 1040° C. The samples were oil quenched from temperature and were subsequently heat treated in four different ways. The tensile properties of the four treatments is given in Table III.

TABLE III

Effect of Prolonged Heat Treatment and Duplex Heat Treatment on Tensile Properties of 5331S 50 mm Bar Solution Treated 1040° C./2 hr OQ (Oil Quenched)

| Specimen Number | Heat Treatment | 0.1% PS $Nmm^{-2}$ | 0.2% PS $Nmm^{-2}$ | UTS $Nmm^{-2}$ | EL5D % | R in A % |
|---|---|---|---|---|---|---|
| 1 | 625° C./2 hours | 852 | 867 | 996 | 13 | 22 |
| 2 | 560° C./100 hours | 871 | 909 | 1026 | 11 | 16.5 |
| 3 | 560° C./100 hours + 650° C./24 hours | 887 | 907 | 1010 | 9 | 14 |
| 4 | 580° C./100 hours + 650° C./24 hours | 892 | 912 | 1019 | 9 | 13 |

In the table the "0.1%PS" refers to the 0.1% proof strength. The "$Nmm^{-2}$" means Newtons per $mm^2$. The term "UTS" means ultimate tensile strength. The term "EL5D%" refers to the elongation on a gauge length of 5 times the diameter of the sample section. The "R in A%" refers to the reduction in area measured at the break. It can be seen that reducing the stress relief treatment temperature and increasing the stress relief treatment time gives an improvement in the proof strength and tensile strength of the materials and that the duplex stress relief treatment given to Samples 3 and 4 gives further increases in the tensile strength at the expense of ductility as measured by the elongation and reduction in area.

A further thirteen samples of 5331S were taken and solution treated at 1050° C. for 2 hours and then oil quenched. After the solution treatment the samples were given a duplex heat treatment and the results are given in Table IV.

TABLE IV

Effect of Duplex Heat Treatment on Tensile Properties of 5331S 50 mm ∅ Bar - Solution Treated at 1050° C./2 hour Oil Quench

| Sample Number | Heat Treatments | | 0.1% PS $Nmm^{-2}$ | 0.2% PS $Nmm^{-2}$ | UTS $Nmm^{-2}$ | EL5D % | R in A % |
|---|---|---|---|---|---|---|---|
| 5 | 425° C./24 hr | 625° C./8 hr | 850 | 867 | 1002 | 12 | 17 |
| 6 | | 625° C./24 hr | 869 | 887 | 1002 | 5 | 8 |
| 7 | | 625° C./48 hr | 868 | 888 | 1002 | 8.5 | 13 |
| 8 | 475° C./24 hr | 625° C./2 hr | 826 | 850 | 987 | 11 | 20 |
| 9 | | 625° C./8 hr | 861 | 875 | 998 | 11 | 15 |
| 10 | | 625° C./24 hr | 858 | 880 | 998 | 10 | 13 |
| 11 | 525° C./2 hr | 625° C./2 hr | 840 | 863 | 998 | 11 | 15 |
| 12 | | 625° C./8 hr | 853 | 868 | 1002 | 12.5 | 17 |
| 13 | | 625° C./24 hr | 861 | 883 | 1004 | 10 | 12 |
| 14 | 525° C./24 hr | 625° C./2 hr | 848 | 867 | 1004 | 13.5 | 22 |
| 15 | | 625° C./8 hr | 855 | 878 | 1006 | 13 | 22 |
| 16 | | 625° C./24 hr | 873 | 891 | 1012 | 12 | 19 |
| 17 | 525° C./48 hr | 600° C./100 hr | 896 | 918 | 1016 | 6.5 | 9 |
| 18 | | 625° C./24 hr | 884 | 904 | 1002 | 6 | 9 |

It can be seen from Table IV that within any group 567, 8910, 11 12 13, and 14 15 16, that increasing the length of time of the second heat treatment gives an increase in strength of the alloy. It is particularly noticeable in samples 14 15 and 16 that this increase in strength is not accompanied by any significant loss of ductility.

It can also be seen that optimum results appear to follow the duplex heat treatment given to Sample 17 insofar as the tensile strength is concerned. However, when comparing both tensile and ductile properties the optimum results appear to be those obtained with Sample 16.

Following the preliminary investigation outlined above further investigation took place to establish the effect of duplex heat treatment using a lower temperature first heat treatment followed by extended times at and around 625° C. In a second further stage duplex heat treatments using extended times at 625° C. were followed by a further set of heat treatments at lower treatment temperatures. All treatments were carried out on 50 mm diameter bars solution treated in full section at 1 050° C. for 2 hours and then oil quenched.

The test pieces for the treatments were cut from the bar with the majority of the exterior of the bar being rejected during the machining operation. It was not possible to carry out the entire programme on material from one batch and the material used for the investigation of lower temperatures for the primary treatment followed by extended heat treatments at 625° C. had a beta grain size of approximately 0.5 mm compared to a rather coarser beta grain size for the second set of experiments (the grain size in that case being approximately 1 mm). As a result it is not possible to compare directly the results between the two parts although this in itself is not an essential requirement. The range of heat treatments is illustrated in Tables V to X.

TABLE V

| Stress Relief Heat Treatment(s) | Creep @ 600° C./200 $Nmm^{-2}$ TPS 100 hr % | 300 hr % | 0.1% PS $Nmm^{-2}$ | 0.2% PS $Nmm^{-2}$ | UTS $Nmm^{-2}$ | EL5D % | R in A % |
|---|---|---|---|---|---|---|---|
| 625° C./2 hrs | — | — | 836 | 859 | 971 | 13.5 | 26.5 |
| (5331S STD (standard) | 0.571 | 1.525 | #898 | 916 | 994 | 5.5 | 10.5# |
| 500° C./24 hr + 625° C./8 hr | — | — | 850 | 867 | 972 | 14 | 23.5 |
| | 0.481 | 1.480 | #903 | 921 | 1003 | 5 | 9.5# |
| 500° C./24 hr + 625° C./24 hr | — | — | 861 | 881 | 993 | 12.5 | 21 |
| | 0.597 | 1.839 | #899 | 914 | 999 | 6.5 | 11.5# |
| 500° C./24 hr + 625° C./48 hr | — | — | 861 | 885 | 982 | 13 | 19 |
| | 0.550 | 1.717 | #893 | 908 | 982 | 6.5 | 8.5# |
| 500° C./24 hr + 600° C./24 hr | — | — | 844 | 861 | 967 | 13.5 | 23 |
| | 0.510 | 1.408 | #891 | 905 | 991 | 5.5 | 9.5# |
| 500° C./24 hr + 650° C./24 hr | — | — | 847 | 861 | 959 | 14 | 19 |
| | 0.568 | 1.854 | #899 | 912 | 984 | 4 | 8.5# |
| Average (Excl STD) | — | — | 853 | 871 | 975 | 13.4 | 21.1 |
| | 0.541 | 1.660 | #897 | 912 | 992 | 5.5 | 9.5# |

#All Post Creep Tensile Test Samples had their Surfaces Retained.

TABLE VI

| Stress Relief Heat Treatments(s) | Creep @ 600° C./200$Nmm^{-2}$ TPS 100 hr % | 300 hr % | 0.1% PS $Nmm^{-2}$ | 0.2% PS $Nmm^{-2}$ | UTS $Nmm^{-2}$ | EL5D % | R in A % |
|---|---|---|---|---|---|---|---|
| 625° C./2 hrs | — | — | 836 | 859 | 971 | 13.5 | 26.5 |
| (5331S STD) | 0.571 | 1.525 | #898 | 916 | 994 | 5.5 | 10.5# |
| 510° C./24 hr + 625° C./8 hr | — | — | 839 | 856 | 963 | 13 | 22.5 |
| | 0.491 | 1.444 | #901 | 920 | 998 | 5.5 | 8.5# |
| 510° C./24 hr + 625° C./24 hr | — | — | 854 | 872 | 969 | 15 | 19.5 |
| | 0.572 | 1.845 | #889 | 910 | 976 | 5.5 | 8.5# |

TABLE VI-continued

| Stress Relief Heat Treatments(s) | Creep @ 600° C./200Nmm$^{-2}$ TPS 100 hr % | 300 hr % | 0.1% PS Nmm$^{-2}$ | 0.2% PS Nmm$^{-2}$ | UTS Nmm$^{-2}$ | EL5D % | R in A % |
|---|---|---|---|---|---|---|---|
| 510° C./24 hr + 625° C./48 hr | — | — | 866 | 883 | 980 | 14 | 21 |
| | 0.476 | 1.635 | #899 | 914 | 998 | 6 | 10# |
| 510° C./24 hr + 600° C./24 hr | — | — | 851 | 871 | 978 | 13.5 | 23 |
| | 0.611 | 1.840 | #898 | 913 | 995 | 5 | 10# |
| 510° C./24 hr + 650° C./24 hr | — | — | 855 | 874 | 971 | 9 | 14.5 |
| | 0.580 | 1.964 | #898 | 908 | 979 | 5 | 10#* |
| Average (Excl STD) | — | — | 853 | 871 | 972 | 12.9 | 20.1 |
| | 0.546 | 1.746 | #897 | 913 | 989 | 5.4 | 9.4# |

#All Post Creep Tensile Samples had their Surfaces Retained.
*Extra heating of 4 hrs/600° C. on loading for 300 hr creep.

TABLE VII

| Stress Relief Heat Treatment(s) | Creep @ 600° C./200Nmm$^{-2}$ TPS 100 hr % | 300 hr % | 0.1% PS Nmm$^{-2}$ | 0.2% PS Nmm$^{-2}$ | UTS Nmm$^{-2}$ | EL5D % | R in A % |
|---|---|---|---|---|---|---|---|
| 625° C./2 hrs | — | — | 836 | 859 | 971 | 13.5 | 26.5 |
| (5331S STD) | 0.571 | 1.525 | #898 | 916 | 994 | 5.5 | 10.5# |
| 520° C./24 hr + 625° C./8 hr | — | — | 843 | 857 | 957 | 14.5 | 23 |
| | 0.485 | 1.592 | #901 | 917 | 989 | 5.5 | 8.5# |
| 520° C./24 hr + 625° C./24 hr | — | — | 866 | 882 | 987 | 10 | 21 |
| | 0.532 | 1.731 | #896 | 911 | 991 | 6 | 10.5# |
| 520° C./24 hr + 625° C./48 hr | — | — | 874 | 894 | 991 | 10.5 | 21 |
| | 0.530 | 1.774 | #891 | 906 | 994 | 6 | 12.5# |
| 520° C./24 hr + 600° C./24 hr | — | — | 852 | 870 | 980 | 13 | 21 |
| | 0.625 | 1.880 | #892 | 900 | 991 | 3 | 11# |
| 520° C./24 hr + 650° C./24 hr | — | — | 864 | 883 | 985 | 9 | 12 |
| | 0.505 | 1.508 | #889 | 912 | 999 | 4.5 | 8# |
| Average (Excl STD) | — | — | 860 | 877 | 980 | 11.4 | 19.6 |
| | 0.535 | 1.697 | #894 | 909 | 993 | 5 | 10.1# |

#All Post Creep Tensile Samples had their Surfaces Retained.

TABLE VIII

| Stress Relief Heat Treatment(s) | Creep @ 600° C./200Nmm$^{-2}$ TPS 100 hr % | 300 hr % | 0.1% PS Nmm$^{-2}$ | 0.2% PS Nmm$^{-2}$ | UTS Nmm$^{-2}$ | EL5D % | R in A % |
|---|---|---|---|---|---|---|---|
| 625° C./2 hrs | — | — | 836 | 859 | 971 | 13.5 | 26.5 |
| (5331S STD) | 0.571 | 1.525 | #898 | 916 | 994 | 5.5 | 10.5# |
| 530° C./24 hr + 625° C./8 hr | — | — | 848 | 869 | 973 | 11 | 18.5 |
| | 0.485 | 1.352 | #901 | 919 | 1002 | 4 | 7# |
| 530° C./24 hr + 625° C./24 hr | — | — | 850 | 877 | 992 | 14 | 17 |
| | 0.426 | 1.226 | #903 | 917 | 1008 | 4.5 | 7.5# |
| 530° C./24 hr + 625° C./48 hr | — | — | 871 | 890 | 985 | 13.5 | 19.5 |
| | 0.462 | 1.456 | #901 | 918 | 1007 | 3 | 8.5# |
| 530° C./24 hr + 600° C./24 hr | — | — | 860 | 881 | 992 | 13.5 | 22 |
| | 0.511 | 1.435 | #905 | 921 | 1003 | 4 | 8.5# |
| 530° C./24 hr + 650° C./24 hr | — | — | 852 | 872 | 974 | 11.5 | 15.5 |
| | 0.470 | 1.663 | #900 | 916 | 991 | 3 | 7.5# |
| Average (Excl STD) | — | — | 856 | 878 | 983 | 12.7 | 18.5 |
| | 0.471 | 1.426 | #902 | 918 | 1002 | 3.7 | 7.8# |

#All Post Creep Tensile Samples had their Surfaces Retained.

TABLE IX

| Stress Relief Heat Treatment(s) | Creep @ 600° C./200Nmm$^{-2}$ TPS 100 hr % | 300 hr % | 0.1% PS Nmm$^{-2}$ | 0.2% PS Nmm$^{-2}$ | UTS Nmm$^{-2}$ | EL5D % | R in A % |
|---|---|---|---|---|---|---|---|
| 625° C./2 hrs | — | — | 836 | 859 | 971 | 13.5 | 26.5 |
| (5331S STD) | 0.571 | 1.525 | #898 | 916 | 994 | 5.5 | 10.5# |
| 540° C./24 hr + 625° C./8 hr | — | — | 844 | 865 | 973 | 14 | 20.5 |
| | 0.477 | 1.430 | #897 | 919 | 1014 | 5 | 8.5# |
| 540° C./24 hr + 625° C./24 hr | — | — | 860 | 876 | 974 | 12 | 16 |
| | 0.419 | 1.250 | #905 | 920 | 994 | 4 | 6# |
| 540° C./24 hr + 625° C./48 hr | — | — | 863 | 883 | 984 | 13 | 17.5 |
| | 0.424 | 1.447 | #915 | 931 | 1013 | 4 | 7.5# |

TABLE IX-continued

| Stress Relief Heat Treatment(s) | Creep @ 600° C./200Nmm$^{-2}$ TPS 100 hr % | 300 hr % | 0.1% PS Nmm$^{-2}$ | 0.2% PS Nmm$^{-2}$ | UTS Nmm$^{-2}$ | EL5D % | R in A % |
|---|---|---|---|---|---|---|---|
| 540° C./24 hr + 600° C./24 hr | — | — | 856 | 874 | 982 | 13 | 20 |
| | 0.475 | 1.480° | #914 | 930 | 1016 | 5 | 7# |
| 540° C./24 hr + 650° C./24 hr | — | — | 856 | 873 | 975 | 11 | 16.5 |
| | 0.518 | 1.615* | #897 | 918 | 1009 | 5.5 | 11# |
| Average (Excl STD) | — | — | 856 | 874 | 978 | 12.6 | 18.1 |
| | 0.463 | 1.444 | #906 | 924 | 1009 | 4.7 | 8# |

#All Post Creep Tensile Samples had their Surfaces Retained.
°Temperature drop during 300 hr creep test to a minimum of 440° C. for 6 hours.
*Extra heating of 4 hrs/600° C. on loading for 300 hr creep.

TABLE X

| Stress Relief Heat Treatment(s) | Creep @ 600° C./200Nmm$^{-2}$ TPS 100 hr % | 300 hr % | 0.1% PS Nmm$^{-2}$ | 0.2% PS Nmm$^{-2}$ | UTS Nmm$^{-2}$ | EL5D % | R in A % |
|---|---|---|---|---|---|---|---|
| 625° C./2 hrs | — | — | 836 | 859 | 971 | 13.5 | 26.5 |
| (5331S STD) | 0.571 | 1.525 | #898 | 916 | 994 | 5.5 | 10.5# |
| 550° C./24 hr + 625° C./8 hr | — | — | 845 | 868 | 975 | 12 | 17 |
| | 0.453 | 1.379 | #904 | 917 | 1022 | 5.5 | 8# |
| 550° C./24 hr + 625° C./24 hr | — | — | 855 | 876 | 979 | 12 | 17.5 |
| | 0.515 | 1.528 | #907 | 926 | 1002 | 6.5 | 6.5# |
| 550° C./24 hr + 625° C./48 hr | — | — | 872 | 891 | 995 | 10 | 14 |
| | 0.393 | 1.132 | #915 | 934 | 1011 | 2 | 5.5# |
| 550° C./24 hr + 600° C./24 hr | — | — | 859 | 881 | 998 | 15 | 17.5 |
| | 0.357 | 1.032° | #915 | 934 | 1014 | 5 | 8# |
| 550° C./24 hr + 650° C./24 hr | — | — | 858 | 881 | 994 | 10 | 13 |
| | 0.384 | 1.224 | #928 | 937 | 1031 | 5.5 | 7# |
| Average (Excl STD) | — | — | 858 | 879 | 988 | 11.8 | 15.8 |
| | 0.420 | 1.259 | #914 | 930 | 1016' | 4.9 | 7# |

#All Post Creep Tensile Samples had their Surfaces Retained.
°Temperature drop during 300 hr creep test to a minimum of 400° C. for 6 hours.

Tensile room temperature tests were carried out as were creep tests to measure the total plastic strain after 100 hours and 300 hours at 600° C. under a stress of 200N/mm$^2$. In addition post creep tensile tests of samples having had 300 hours at 600° C. were carried out with the surface retained. The test results for the first part of the investigation are given in Tables V to X and the results are averaged for particular primary or secondary treatments and given in Table XI. The results for the second series of heat treatments are given in Tables XII to XIV. The average of the results for particular primary or secondary treatments is given in Table XV.

| Average of all Results Given | | Unexposed Tensile Data 0.2% PS Nmm$^{-2}$ | UTS | EL5D % | R in A % | Creep Data 600° C./200Nmm$^{-2}$ TPS 100 hr % | 300 hr % | Tensile Data After 300 hr/600° C. (Surface Retained) 0.2% PS Nmm$^{-2}$ | UTS | EL5D % | R in A % |
|---|---|---|---|---|---|---|---|---|---|---|---|
| TABLE XI(a) | | | | | | | | | | | |
| A Primary Treatment of | 24 hr/ 500° C. | 871 | 975 | 13.4 | 21.1 | 0.541 | 1.660 | 912 | 992 | 5.5 | 9.5 |
| A Primary Treatment of | 24 hr/ 510° C. | 871 | 972 | 12.9 | 20.1 | 0.546 | 1.746 | 913 | 989 | 5.4 | 9.4 |
| A Primary Treatment of | 24 hr/ 520° C. | 877 | 980 | 11.4 | 19.6 | 0.535 | 1.697 | 909 | 993 | 5.0 | 10.1 |
| A Primary Treatment of | 24 hr/ 530° C. | 878 | 983 | 12.7 | 18.5 | 0.471 | 1.426 | 918 | 1002 | 3.7 | 7.8 |
| A Primary Treatment of | 24 hr/ 540° C. | 874 | 978 | 12.6 | 18.1 | 0.463 | 1.444 | 924 | 1009 | 4.7 | 8 |
| A Primary Treatment of | 24 hr/ 550° C. | 879 | 988 | 11.8 | 15.8 | 0.420 | 1.259 | 930 | 1016 | 4.9 | 7 |
| TABLE XI(b) | | | | | | | | | | | |
| A Secondary Treatment at | 8 hr/ 625° C. | 864 | 969 | 13.1 | 20.8 | 0.479 | 1.442 | 919 | 1005 | 5.1 | 8.3 |
| A Secondary Treatment at | 24 hr/ 625° C. | 877 | 982 | 12.6 | 18.7 | 0.510 | 1.570 | 916 | 995 | 5.5 | 8.4 |
| A Secondary Treatment at | 48 hr/ 625° C. | 888 | 986 | 12.3 | 18.7 | 0.473 | 1.527 | 919 | 1001 | 4.6 | 8.8 |
| A Secondary Treatment at | 24 hr/ 600° C. | 873 | 983 | 13.6 | 21.1 | 0.515 | 1.513 | 917 | 1002 | 4.6 | 9 |
| A Secondary Treatment at | 24 hr/ 625° C. | 877 | 982 | 12.6 | 18.7 | 0.510 | 1.570 | 916 | 995 | 5.5 | 8.4 |

-continued

| Average of all Results Given | | Unexposed Tensile Data 0.2% PS Nmm$^{-2}$ | UTS Nmm$^{-2}$ | EL5D % | R in A % | Creep Data 600° C./200Nmm$^{-2}$ TPS 100 hr % | 300 hr % | Tensile Data After 300 hr/600° C. (Surface Retained) 0.2% PS Nmm$^{-2}$ | UTS Nmm$^{-2}$ | EL5D % | R in A % |
|---|---|---|---|---|---|---|---|---|---|---|---|
| A Secondary Treatment at STD | 24 hr/ 650° C. | 874 | 976 | 10.8 | 15.1 | 0.504 | 1.638 | 917 | 999 | 4.6 | 8.7 |
| | | 859 | 971 | 13.5 | 26.5 | 0.571 | 1.525 | 916 | 994 | 5.5 | 10.5 |

TABLE XII

| Stress Relief Heat Treatment(s) | Creep @ 600° C./200Nmm$^{-2}$ TPS 100 hr % | 300 hr % | 0.1% PS Nmm$^{-2}$ | 0.2% PS Nmm$^{-2}$ | UTS Nmm$^{-2}$ | EL5D % | R in A % |
|---|---|---|---|---|---|---|---|
| 625° C./2 hrs | — | — | 833 | 853 | 979 | 10.5 | 17 |
| (5331S STD) | 0.578 | 1.757 | #912 | 922 | 1010 | 5.5 | 8.5# |
| 625° C./8 hr + 500° C./24 hr | — | — | 889 | 907 | 1010 | 7.5 | 13.5 |
| | 0.403 | 1.251 | #921 | 937 | 1025 | 2 | 6.5# |
| 625° C./8 hr + 510° C./24 hr | — | — | 891 | 904 | 1008 | 7.5 | 9 |
| | 0.470 | 1.444 | #917 | 937 | 1010 | 1.5 | 5# |
| 625° C./8 hr + 520° C./24 hr | — | — | 888 | 902 | 1006 | 7 | 10 |
| | 0.407 | 1.267 | #922 | 936 | 1011 | 1 | 3# |
| 625° C./8 hr + 530° C./24 hr | — | — | 895 | 909 | 1015 | 8.5 | 14 |
| | 0.462 | 1.423* | #907 | 923 | 1027 | 2 | 7# |
| 625° C./8 hr + 540° C./24 hr | — | — | 889 | 908 | 1014 | 6.5 | 10.5 |
| | 0.409 | 1.223 | #919 | 933 | 1013 | 2.5 | 4# |
| 625° C./8 hr + 550° C./24 hr | — | — | 887 | 902 | 1008 | 7.5 | 13.5 |
| | 0.393 | 1.376 | #912 | 931 | 1013 | 3 | 5# |
| Average (Excl STD) | — | — | 890 | 905 | 1010 | 7.4 | 11.8 |
| | 0.424 | 1.331 | #916 | 933 | 1017 | 2 | 5.1# |

#All Post Creep Tensile Samples had their Surfaces Retained.
*Extra heating of 8 hrs/600° C. on loading for 300 hr creep.

TABLE XIII

| Stress Relief Heat Treatment(s) | Creep @ 600° C./200Nmm$^{-2}$ TPS 100 hr % | 300 hr % | 0.1% PS Nmm$^{-2}$ | 0.2% PS Nmm$^{-2}$ | UTS Nmm$^{-2}$ | EL5D % | R in A % |
|---|---|---|---|---|---|---|---|
| 625° C./2 hrs | — | — | 833 | 853 | 979 | 10.5 | 17 |
| (5331S STD) | 0.578 | 1.757 | #912 | 922 | 1010 | 5.5 | 8.5# |
| 625° C./24 hr + 500° C./24 hr | — | — | 885 | 904 | 1002 | 4.5 | 10 |
| | 0.475 | 1.483 | #911 | 927 | 1017 | 3.5 | 4# |
| 625° C./24 hr + 510° C./24 hr | — | — | 900 | 915 | 1012 | 4.5 | 7.5 |
| | 0.463 | 1.466 | #910 | 925 | 1020 | 2.5 | 6.5# |
| 625° C./24 hr + 520° C./24 hr | — | — | 897 | 913 | 1015 | 5.5 | 11 |
| | 0.459 | 1.398 | #902 | 922 | 1019 | 4 | 6# |
| 625° C./24 hr + 530° C./24 hr | — | — | 897 | 915 | 1012 | 6 | 9 |
| | 0.401 | 1.206 | #917 | 936 | 1022 | 3.5 | 8# |
| 625° C./24 hr + 540° C./24 hr | — | — | 897 | 918 | 1020 | 6 | 11 |
| | 0.418 | 1.427 | #913 | 928 | 1008 | 3.5 | 7.5# |
| 625° C./24 hr + 550° C./24 hr | — | — | 904 | 920 | 1027 | 4 | 8 |
| | 0.513 | 1.668 | #913 | 930 | 1017 | 3.5 | 6.5# |
| Average (Excl STD) | — | — | 897 | 914 | 1015 | 5.1 | 9.4 |
| | 0.455 | 1.441 | #911 | 928 | 1017 | 3.4 | 6.4# |

#All Post Creep Tensile Samples had their Surfaces Retained.

TABLE XIV

| Stress Relief Heat Treatment(s) | Creep @ 600° C./200Nmm$^{-2}$ TPS 100 hr % | 300 hr % | 0.1% PS Nmm$^{-2}$ | 0.2% PS Nmm$^{-2}$ | UTS Nmm$^{-2}$ | EL5D % | R in A % |
|---|---|---|---|---|---|---|---|
| 625° C./2 hrs | — | — | 833 | 853 | 979 | 10.5 | 17 |
| (5331S STD) | 0.578 | 1.757 | #912 | 922 | 1010 | 5.5 | 8.5# |
| 625° C./48 hr + 500° C./24 hr | — | — | 901 | 913 | 1009 | 5 | 7 |
| | 0.494 | 1.498 | #913 | 930 | 1018 | 4 | 7# |
| 625° C./48 hr + 510° C./24 hr | — | — | 905 | 917 | 1021 | 6 | 8.5 |
| | 0.489* | 1.480 | #899 | 920 | 1003 | 3.5 | 8.5# |
| 625° C./48 hr + 520° C./24 hr | — | — | 901 | 917 | 1020 | 3.5 | 7 |
| | 0.481* | 1.695 | #909 | 927 | 1011 | 4 | 7.5# |
| 625° C./48 hr + 530° C./24 hr | — | — | 898 | 916 | 1018 | 5.5 | 6.5 |
| | 0.483 | 1.732 | #899 | 922 | 1006 | 5 | 11# |

TABLE XIV-continued

| Stress Relief Heat Treatment(s) | Creep @ 600° C./200Nmm$^{-2}$ TPS 100 hr % | 300 hr % | 0.1% PS Nmm$^{-2}$ | 0.2% PS Nmm$^{-2}$ | UTS Nmm$^{-2}$ | EL5D % | R in A % |
|---|---|---|---|---|---|---|---|
| 625° C./48 hr + 540° C./24 hr | — | — | 901 | 917 | 1014 | 5.5 | 6.5 |
| | 0.469 | 1.561** | #910 | 926 | 1009 | 3.5 | 8.5# |
| 625° C./48 hr + 550° C./24 hr | — | — | 900 | 916 | 1020 | 6 | 10 |
| | 0.452 | 1.407 | #917 | 932 | 1017 | 3.5 | 6# |
| Average (Excl STD) | — | — | 901 | 916 | 1017 | 5.3 | 7.6 |
| | 0.478 | 1.562 | #908 | 926 | 1011 | 3.9 | 8.1# |

#All Post Creep Tensile Samples had their Surfaces Retained.
°Value at 117 hours.
*Extra heating of up to 24 hrs/600° C. on loading for 300 hr creep test.
**Temperature dropped down to 592° C. for up to 17 hours.

TABLE XV

| Average of all Results Given | | Unexposed Tensile Data 0.2% PS Nmm$^{-2}$ | UTS | EL5D % | R in A % | Creep Data 600° C./200Nmm$^{-2}$ TPS 100 hr % | 300 hr % | Tensile Data After 300 hr/600° C. (Surface Retained) 0.2% PS Nmm$^{-2}$ | UTS | EL5D % | R in A % |
|---|---|---|---|---|---|---|---|---|---|---|---|
| A Primary Treatment of | 8 hr/ 625° C. | 905 | 1010 | 7.4 | 11.8 | 0.424 | 1.331 | 933 | 1017 | 2.0 | 5.1 |
| A Primary Treatment of | 24 hr/ 625° C. | 914 | 1015 | 5.1 | 9.4 | 0.455 | 1.441 | 928 | 1017 | 3.4 | 6.4 |
| A Primary Treatment of | 48 hr/ 625° C. | 916 | 1017 | 5.3 | 7.6 | 0.478 | 1.562 | 926 | 1011 | 3.9 | 8.1 |
| A Secondary Treatment of | 24 hr/ 500° C. | 908 | 1007 | 5.7 | 10.2 | 0.457 | 1.411 | 931 | 1020 | 3.2 | 5.8 |
| A Secondary Treatment of | 24 hr/ 510° C. | 912 | 1014 | 6 | 8.3 | 0.474 | 1.463 | 927 | 1011 | 2.5 | 6.7 |
| A Secondary Treatment of | 24 hr/ 520° C. | 911 | 1014 | 5.3 | 9.3 | 0.449 | 1.453 | 928 | 1014 | 3.0 | 5.5 |
| A Secondary Treatment of | 24 hr/ 530° C. | 913 | 1015 | 6.7 | 9.8 | 0.449 | 1.454 | 927 | 1018 | 3.5 | 8.7 |
| A Secondary Treatment of | 24 hr/ 540° C. | 914 | 1016 | 6 | 9.3 | 0.432 | 1.404 | 929 | 1010 | 3.2 | 6.7 |
| A Secondary Treatment of | 24 hr/ 550° C. | 913 | 1018 | 5.8 | 10.5 | 0.453 | 1.484 | 931 | 1016 | 3.3 | 5.8 |
| STD | | 853 | 979 | 10.5 | 17 | 0.578 | 1.757 | 922 | 1010 | 5.5 | 8.5 |

FIG. 1, which is a graph of total plastic strain TPS against the primary heat treatment, shows averaged results for secondary heat treatment at a number of temperatures for different times. The reference point STD shows the TPS for solution treated material which is treated at 625° C. for 2 hours the so called standard treatment. It can be seen that increasing the primary temperature from 500° C. to 550° C. results in a general improvement in creep strength as measured by TPS from an average of approximately 0.575% to approximately 0.45%. It is worth noting that the use of a primary treatment irrespective of temperature leads to a general improvement in creep strength irrespective of the time or temperature of the secondary treatment used.

Figure 2:
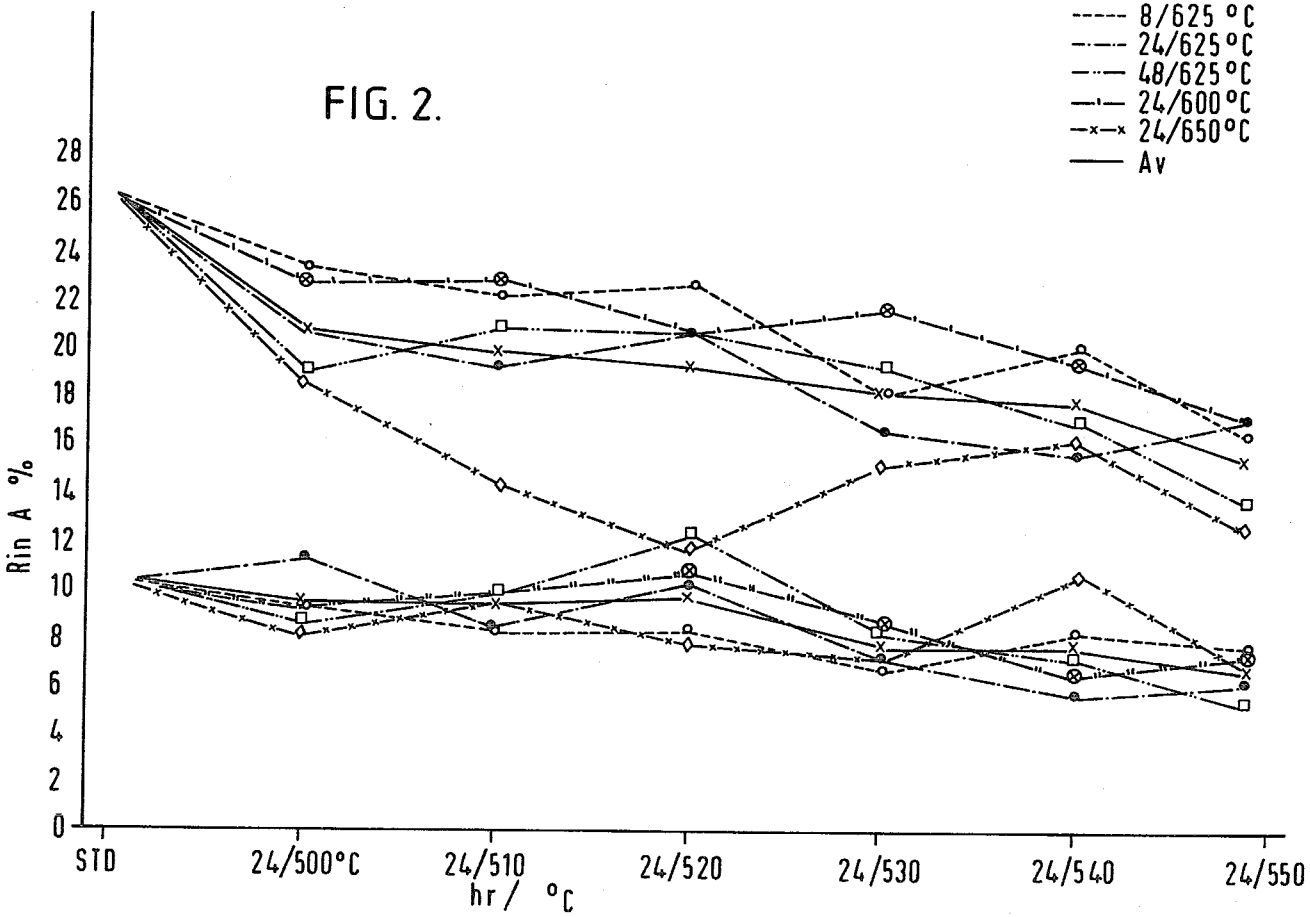
FIG. 2 is a graph of reduction in area percentage against primary heat treatment hrs/°C.

FIG. 2 shows that the primary treatment has little effect on the post creep ductility of the material compared to material given the so called standard treatment. In FIG. 2 the upper series of lines corresponds to the ductility as measured by R in A percentage of unexposed material. The lower series of lines corresponds to R in A measurements on samples tested in the post creep state having had 300 hours creep at 600° C. at a stress of 200N/mm$^2$. Although it can be seen that there is a fall off in the unexposed ductility there is very little fall off in the post creep ductility for material given primary treatment at a series of temperatures between 500° C. and 550° C. It can also be seen that there is very little difference in post creep ductility in the particular secondary treatment whether it be 8 hours at 625° C. or 24 hours at 600° C. or 24 hours at 650° C.

Figure 3:
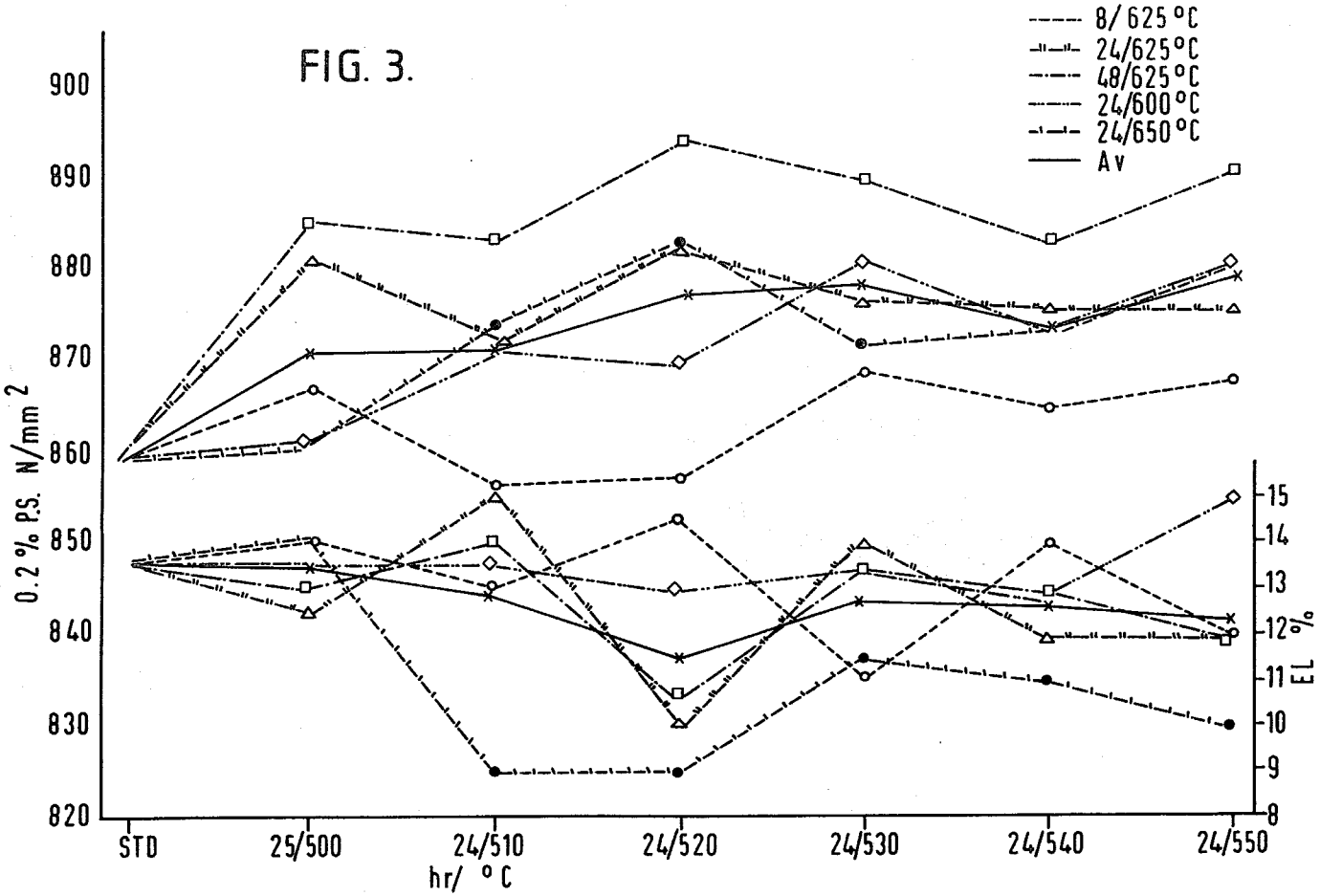
FIG. 3 is a graph of 0.2% proof stress and elongation against primary heat treatment hrs/°C.

The effects of varying the primary treatment on the 0.2% proof stress and the elongation as measured by percentage elongation at break is illustrated in FIG. 3. The upper series of lines corresponds to the 0.2% proof stress measurements and the lower series of lines corresponds to the elongation at break measured in percentage. These figures illustrate that compared to the so called standard heat treatment the 0.2% proof stress can be increased from approximately 860N/mm$^2$ to about 890N/mm$^2$ whilst the elongation falls only slightly from about 13% to about 12½%. It is interesting to note that there is only a slight loss of elongation whereas the reduction in area is more significantly affected.

The information given above and illustrated in FIGS. 1 to 3 shows, therefore, that in general after creep exposure there is little effect on ductility between the so called standard heat treatment and the duplex treatments whereas there are significant improvements in strength to be obtained and the best compromise of results appears to be present in material given a primary heat treatment of 530° C. to 540° C. for 24 hours.

Considering the effects of the secondary treatment it can be seen that basically improvements in strength and creep resistance have been achieved at the expense of a slight loss of unexposed ductility.

Figure 4:
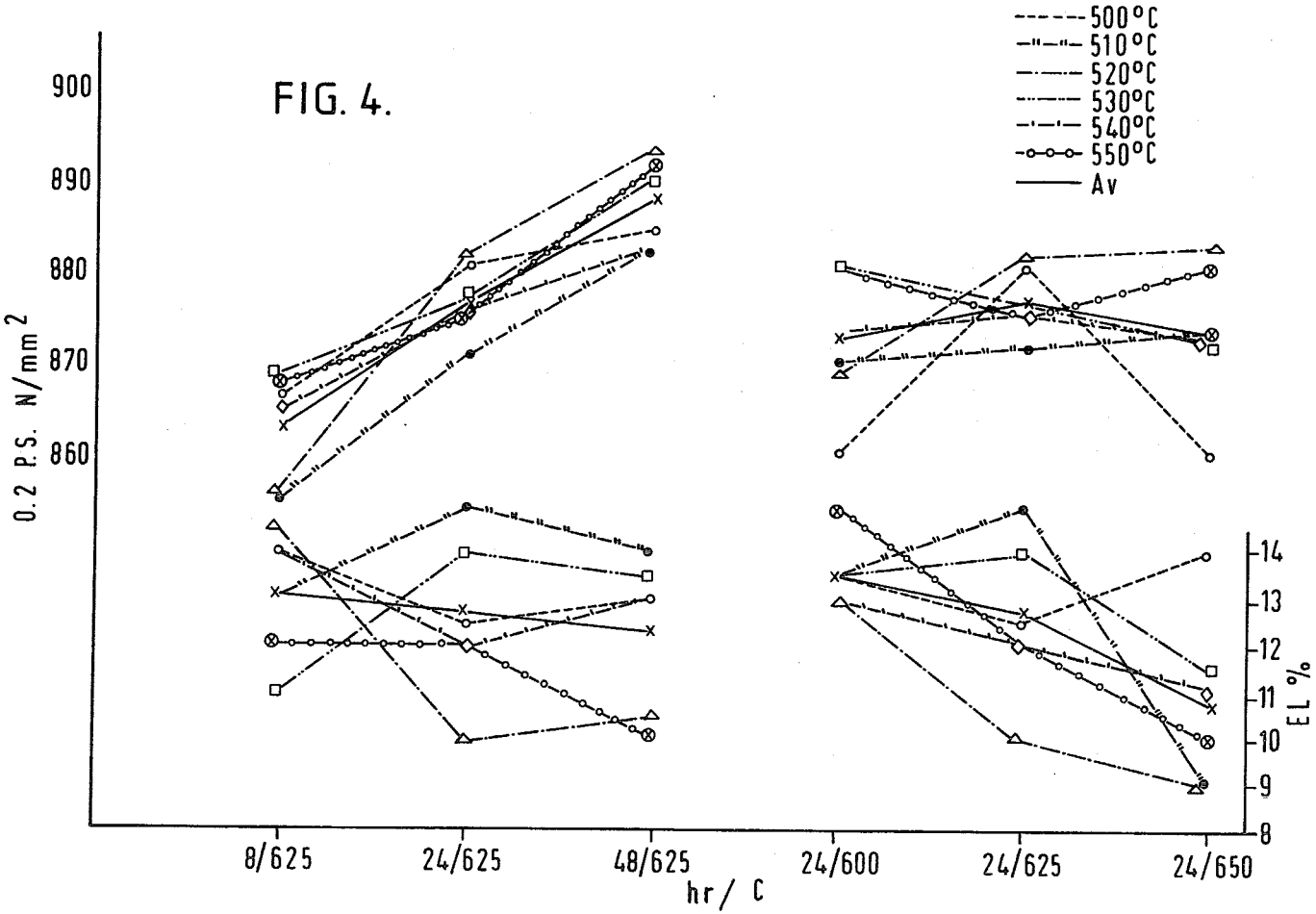
FIG. 4 is a graph of 0.2% proof stress and elongation against secondary heat treatment hrs/°C.

Considering FIG. 4 this shows the effect of increasing the secondary treatment time at 625° C. in the left hand side and on the right hand side shows the effect of increasing the secondary treatment temperature at a constant time of 24 hours. The two upper graphs illustrate the 0.2% proof stress and the two lower graphs are of elongation in percentage. Considering first the graph in the upper left hand corner this shows that increasing the duration of the secondary treatment has a beneficial effect on the 0.2% proof stress. The average rises from approximately 863 to about 887 N/mm$^2$. There is a small reduction in elongation (the lower left hand graph) as measured in the unexposed condition. The graphs on the left hand side relate to material which has had an initial treatment at 500° C., 510° C., 520° C., 530° C., 540° C. and 550° C. as illustrated by the individually identified lines. The average is shown as a solid line between the x's. Thus although it can be seen that increasing the duration of the secondary treatment is beneficial, increasing the temperature at a constant time of 24 hours is less beneficial-see the right hand pair of graphs. The right hand upper graph shows that increasing the temperature of the secondary heat treatment has no significant effect on the proof stress although the proof stress at 625° C. is slightly better than at any other temperature on average. By comparison, however, there is a steady fall in the elongation as is indicated by the lower right hand graph.

Figure 5:
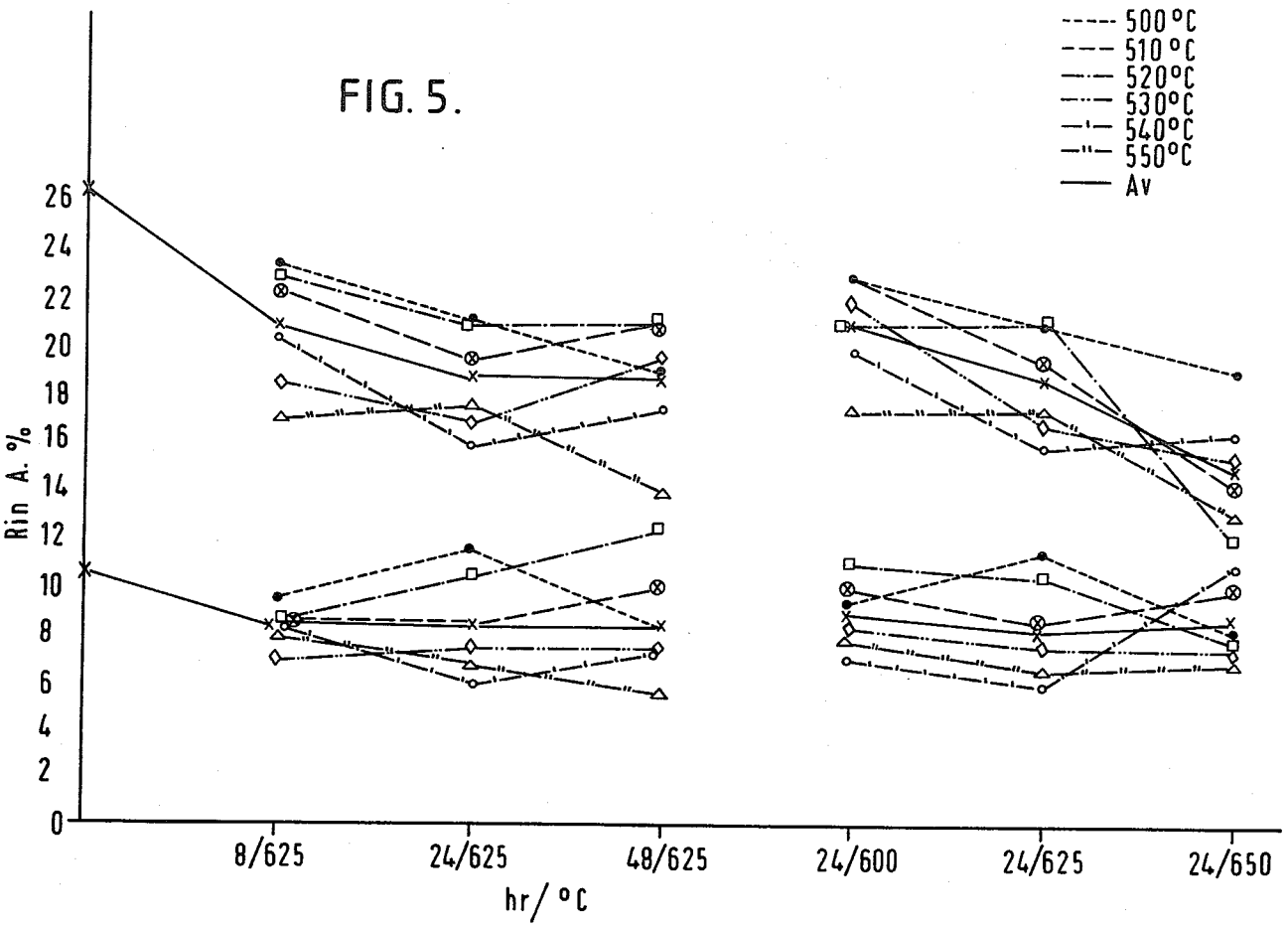
FIG. 5 is a graph of reduction in area against secondary heat treatment hrs/°C.

FIG. 5 shows the effect of the secondary treatments on the ductility of the alloy in the creep tested and non-creep tested conditions. The lower two graphs relate to alloys which are given tensile tests in the post creep condition whereas the two upper graphs relate to alloys tested in the non-creep tested condition. The two graphs on the left hand side illustrate the effects of increasing the duration of the secondary treatment from 8 to 24 to 48 hours whilst keeping the temperature of the heat treatment constant at 625° C. It can be seen that there is little effect on the post creep ductility of the alloy whereas there is a slight fall of in the non-creep tested material. Similarly the effects of holding the time constant at 24 hours but testing at different temperatures shows that the measurements illustrated in the right hand pair of graphs mean the post creep properties are constant whereas there is a fall off in non-creep tested material.

The information given above shows, therefore, that the use of duplex heat treatment enables significant increases in the 0.2% proof stress to be obtained without any serious loss of ductility. There will also be significant improvements in internal stress levels resulting from the use of extended heat treatments. Unexpectedly, however, it has also been discovered that extending the time of the secondary heat treatment at a temperature of 625° C. gives an improvement in creep strength if the original treatment is carried out at a temperature of 530° C. or 540° C. Thus from Table VIII it can be seen that the 100 hour creep strength has not been adversely affected being 0.485 total plastic strain after an 8 hour secondary treatment compared to 0.462 total plastic strain after a 48 hour treatment. The effect is even more significant in material heat treated at 540° C. as shown in Table IX. Even given a 300 hour creep exposure at 600° C. the total plastic strain remains substantially constant at 1.43% after an 8 hour secondary treatment and 1.447% after a 48 hour treatment. These figures are within the normal scatter that is to be found in any experimental evidence. By comparison it can be seen that both the 0.1% and 0.2% proof strengths are improved for the 48 hour treated material, that there is very little effect on the elongation at 5D or in the R in A figures.

By comparison, however, for material given a single stress relief treatment for 2 hours at 625° C. and then creep tested at 540° C. the total plastic strain was 0.084% after 100 hours at 300N/mm$^2$. For material treated at 625° C. for 8 hours the total plastic strain was found to be 0.164% under the same conditions. Logically, therefore, it would have been expected that the same degradation would have occurred for duplex heat treated material. It is not known why this improvement in creep strength is obtained with duplex heat treatment.

The work carried out has also shown that the increase in properties required are more significant when the second treatment is carried out at a higher temperature than the first treatment. Tables XII XIII and XIV show that increasing the temperature from 500° C. to 550° C. as a secondary age has no significant effect on any of the properties, the implication of this is that it is the primary heat treatment which dominates if the primary heat treatment is at a higher temperature than the secondary heat treatment.

It is also becoming apparent that in the particular alloy 5331S secondary treatment at temperatures of about 650° C. appear to cause a reduction in properties, possibly resulting from annealing out of dislocations or some form of spheroidisation of the precipitate within the alloy.

Although the work indicated above has all been carried out on the alloy 5331S it is believed that similar results would be obtained with other near alpha alloys, such as IMI 685 or other such near alpha alloys to be developed in the future.

We claim:

1. A method of heat treating a titanium base alloy containing by weight 5.5% aluminum, 3.5% tin, 3% zirconium, 1% niobium, 0.25% molybdenum, 0.3% silicon which includes the steps of solution treating the alloy at a temperature in the range 1030° C. to 1070° C. and then heat treating the alloy at a temperature of 435° to 635° C. and without mechanically working the alloy giving the alloy a second heat treatment at a higher temperature than the first heat treatment at a temperature of 600° to 700° C. wherein the duration of the first heat treatment is 2 to 168 hours.

2. A method as claimed in claim 1 in which the duration of the second heat treatment is 168 hours.

3. A method as claimed in claim 2 in which the alloy is cooled to ambient temperature between the solution treatment and the first of the heat treatments.

* * * * *